US011197555B2

(12) United States Patent
Wittekind et al.

(10) Patent No.: US 11,197,555 B2
(45) Date of Patent: Dec. 14, 2021

(54) ADJUSTABLE SUPPORT DEVICE

(71) Applicants: William Mitchell Wittekind, Salt Lake City, UT (US); Stela Angelova Markova, Salt Lake City, UT (US); Trevor Oaks Newsom, Salt Lake City, UT (US)

(72) Inventors: William Mitchell Wittekind, Salt Lake City, UT (US); Stela Angelova Markova, Salt Lake City, UT (US); Trevor Oaks Newsom, Salt Lake City, UT (US)

(73) Assignee: Sit Up, LLC, Salt Lake City, UT (US)

( * ) Notice: Subject to any disclaimer, the term of this patent is extended or adjusted under 35 U.S.C. 154(b) by 0 days.

(21) Appl. No.: 16/374,009

(22) Filed: Apr. 3, 2019

(65) Prior Publication Data

US 2019/0307257 A1 Oct. 10, 2019

Related U.S. Application Data

(60) Provisional application No. 62/654,448, filed on Apr. 8, 2018.

(51) Int. Cl.
*A47C 20/04* (2006.01)
*A47C 20/02* (2006.01)

(52) U.S. Cl.
CPC ..... *A47C 20/048* (2013.01); *A47C 20/027* (2013.01); *A47C 20/041* (2013.01)

(58) Field of Classification Search
CPC ..... A47C 20/027; A47C 20/04; A47C 20/041; A47C 20/048; A61G 7/05769; A61G 7/05776; A61G 7/1021; A61G 13/126; A61G 13/1265
USPC ..... 5/615, 413 AM, 613, 614, 616, 655.3, 5/945
See application file for complete search history.

(56) References Cited

U.S. PATENT DOCUMENTS

| | | | | | |
|---|---|---|---|---|---|
| 3,392,412 | A | * | 7/1968 | Aymar | A47C 20/048 5/660 |
| 3,606,623 | A | * | 9/1971 | Aymar | A47C 20/048 5/660 |
| 3,667,075 | A | * | 6/1972 | Ballard | A47C 20/048 5/722 |
| 3,931,653 | A | | 1/1976 | Bien | |
| 3,981,031 | A | | 9/1976 | Schacht | |
| 5,311,625 | A | * | 5/1994 | Barker | A47C 20/027 417/363 |
| 5,345,630 | A | * | 9/1994 | Healy | A47C 20/048 137/270 |
| 5,528,783 | A | | 6/1996 | Kunz et al. | |
| 5,577,278 | A | * | 11/1996 | Barker | A47C 20/027 297/DIG. 10 |
| 5,806,115 | A | | 9/1998 | Brown | |
| 6,012,186 | A | * | 1/2000 | Soltani | A47C 20/048 5/613 |
| 6,139,567 | A | | 10/2000 | McCarty et al. | |

(Continued)

*Primary Examiner* — William V Gilbert

(57) ABSTRACT

The present disclosure relates to assisting patients with treatment and recovery to remain in an upright position. More specifically, the present disclosure is a device that may be used to support patients in an upright position that may be used with any surface. Further, the device may allow the users to vary the angle of support and may be controlled through a simple interface, such as a button, remote control, or controls on an electronic interface device.

17 Claims, 14 Drawing Sheets

(56) References Cited

U.S. PATENT DOCUMENTS

| | | | | |
|---|---|---|---|---|
| 6,298,511 | B1 * | 10/2001 | Collymore | A61G 7/001 5/615 |
| 6,886,204 | B2 | 5/2005 | Kasatshko et al. | |
| 7,231,681 | B2 | 6/2007 | Kasatshko et al. | |
| 7,275,273 | B2 | 10/2007 | Lary et al. | |
| 7,380,301 | B2 | 6/2008 | Chung | |
| 7,475,441 | B1 | 1/2009 | Soberal | |
| 8,146,190 | B1 | 4/2012 | Wolfe | |
| 8,914,926 | B2 | 12/2014 | Berhanu | |
| 2003/0196270 | A1 | 10/2003 | Leventhal et al. | |
| 2005/0155154 | A1 * | 7/2005 | Kasatshko | A47C 27/10 5/713 |
| 2005/0193492 | A1 | 9/2005 | Koshino | |
| 2008/0168604 | A1 | 7/2008 | Cheng | |
| 2010/0242178 | A1 | 9/2010 | Goetting | |
| 2011/0271452 | A1 | 11/2011 | Basilone | |
| 2012/0023669 | A1 | 2/2012 | Graller et al. | |
| 2015/0282630 | A1 * | 10/2015 | McIntyre | A47C 21/06 5/660 |
| 2015/0366368 | A1 * | 12/2015 | Cheng | A47C 7/021 5/644 |
| 2019/0053648 | A1 * | 2/2019 | Santizo | A47C 20/021 |

* cited by examiner

ADJUSTABLE SUPPORT DEVICE

RELATED APPLICATION

This application claims the benefit of Provisional Application No. 62/654,448, filed Apr. 8, 2018, the entire content of which is hereby incorporated by reference.

BACKGROUND

Often, patients are placed on bedrest for some conditions or during recovery. For example, people who have chronic illness, people receiving same-day outpatient surgery, people with sleep apnea, Gastroesophageal reflux disease (GERD), pressure ulcers, hypertension (HTN), hemorrhoids, varicose veins, stroke, vertigo, compression of the spine, back pain, snoring, the elderly, post-surgical patients, or people who have suffered injuries. Frequently, these people are required to remain in an upright position—both while sleeping and awake—and for their caregivers to follow certain head-of-bed (HOB) elevation standards. However, many people cannot afford adjustable and home care beds and adjustable bed frames and bed bases. Other solutions are available, such as wedges, but they only allow for one upright position and the patient must either sit up themselves or have caregivers help lift them up so that the wedge can be placed or removed.

BRIEF DESCRIPTION OF DRAWINGS

The present embodiments will be understood more fully from the detailed description given below and from the accompanying drawings of the present disclosure, which, however, should not be taken to limit the present embodiments, but are for explanation and understanding only.

In consideration of the following detailed description, the embodiments may be more completely understood in connection with the following drawings.

DETAILED DESCRIPTION

The present disclosure relates to an adjustable support device. Often, patients that are placed on bedrest are required to remain in an upright position, both while awake and while sleeping. However, many patients do not own an adjustable bed, nor can they afford one. Although some devices may allow them to remain upright, they cannot be adjusted, thus leaving the patient with two possible positions upright or laying down. Yet other devices may be adjusted manually, but that may be a task the patient cannot perform.

In some embodiments, the device comprises a base (also referred to as a base member) with an adjustable support (also referred to as an adjustable support member) that may rotate with respect to the base. The base and the adjustable support are connected by a hinge element. Connected to both the base and the adjustable support are one or more bladders that may be inflated as a means of rotating the adjustable support.

Additional features and advantages of the present embodiments will be set forth in the description which follows, and in part will be obvious from the description, or may be learned by the practice of the embodiments. The features and advantages of the present embodiments may be realized and obtained by means of the instruments and combinations particularly pointed out in the appended claims. These and other features of the present disclosure will become more fully apparent from the following description and appended claims or may be learned by the practice of the embodiments as set forth hereinafter.

The present disclosure relates to patient care and recovery. For example, people who have chronic illness, people receiving same-day outpatient surgery, people with sleep apnea, GERD (acid reflux), pressure ulcers, HTN, hemorrhoids, varicose veins, stroke, vertigo, compression of the spine, back pain, snoring, the elderly, post-surgical patients, or people who have suffered injuries. Frequently, these people are required to remain in an upright position—both while sleeping and awake—and for their caregivers to follow certain head-of-bed (HOB) elevation standards. However, many people cannot afford adjustable and home care beds and adjustable bed frames and bed bases. Other solutions are available, such as wedges, but they only allow for one upright position and the patient must either sit up themselves or have caregivers help lift them up so that the wedge can be placed or removed. The present embodiments help patients who are confined to bedrest by allowing them to change the angle at which they are sitting. In addition, it may be used by caregivers to raise or lower patients. It should be noted that the adjustable support device of the present disclosure can also be used for general consumer use, such as to read or watch TV and is not limited to patient care and recovery.

Figure 1A:
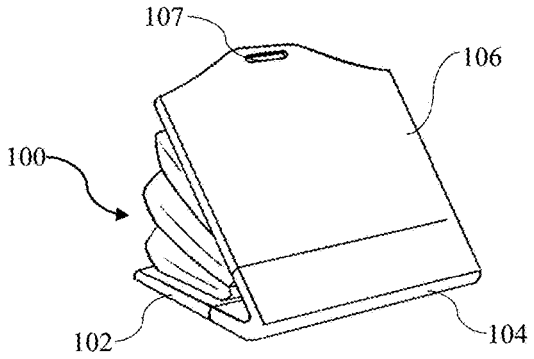
FIGS. 1A, 1B, 1C, 1D, 1E, and 1F illustrate several embodiments of the present disclosure, featuring a base with an adjustable support with and without cushioning.

More specifically, the embodiments may utilize a base 102, as shown in FIG. 1A. The base 102 is connected to an adjustable support 106 through a hinge element 104. Further, FIG. 1A shows how a handle 107 may be formed into the adjustable support 106. In one embodiment, the handle 107 is placed on the adjustable support 106 on that is near the top of the embodiment. However, the handle 107 is not limited to this position and it may be placed anywhere on either the base 102, the adjustable support 106, or on the opposite side as shown in FIG. 1F such that it may be used to carry the embodiment from one place to another.

As shown in FIG. 1A, the hinge element 104 may be placed at the one end of the base 102. However, the hinge element 104 is not limited to this position. Rather, the hinge element 104 may be placed anywhere on the base 102 as long as it is a means to connect the base 102 and the adjustable support 106 in such a way so that it allows the adjustable support to transition rotational with respect to the base 102. The base 102 and the adjustable support 106 may be formed of a shelled-out polycarbonate or polypropylene, or any other similar material, with intermediate supports through the elements.

Figure 1B:
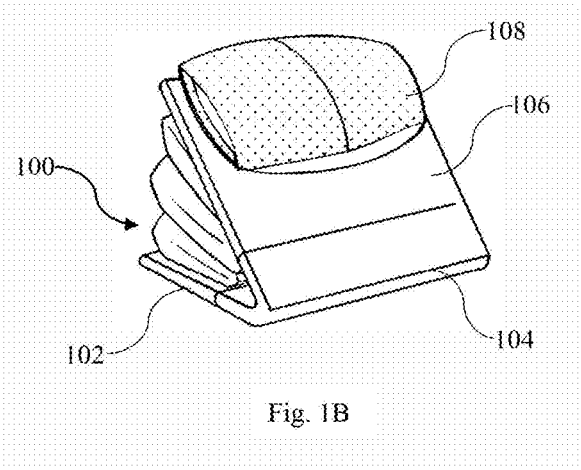
Figure 1C:
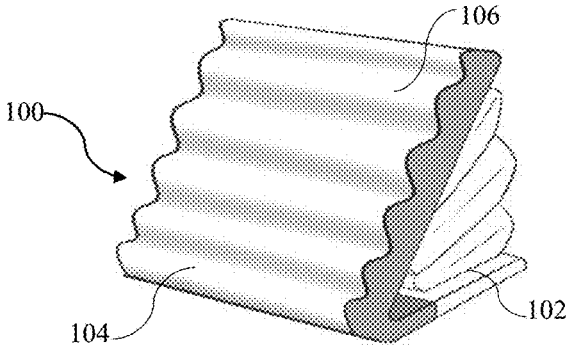
Figure 1D:
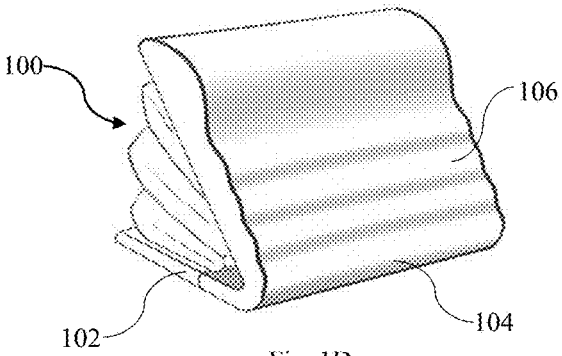
Figure 1E:
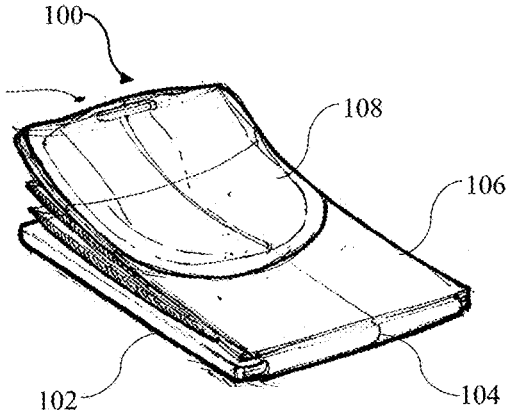
Figure 1F:
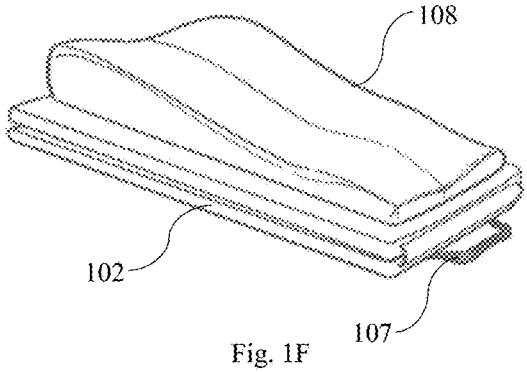

Other embodiments may include additional features, such as a cushion 108, as shown in FIG. 1B. Specifically, in this embodiment the cushion 108 is shown as a case in which a pillow may be placed. Yet other embodiments may include cushioning as part of the adjustable support 106. FIGS. 1C and 1D show two possible embodiments, but there may be others. FIG. 1C shows the adjustable support 106 with wave-like cushioning. Or, as shown in FIG. 1D, the adjustable support 106 may include an ergonomic cushioning pattern. In yet another embodiment, the adjustable support 106 may include a curved cushion 108 as shown in FIG. 1E. FIG. 1F shows an additional embodiment of the cushion 108. In any of these embodiments, the cushion 108 may be formed out of viscoelastic polyurethane foam, such as memory foam. Or, the cushion 108 may be formed of a layered system using a layer hyper-elastic polymer and a layer of polyurethane foam, such as the Purple® Mattress developed by Purple Innovation, Inc., of Alpine Utah.

Figure 2A:
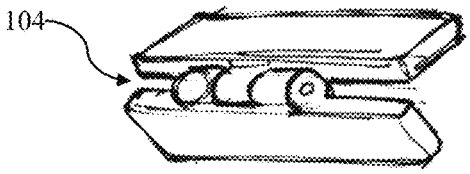
FIGS. 2A, 2B, 2C, 2D, 2E, and 2F illustrate several embodiments of the present disclosure, featuring different hinge elements that may be used.
Figure 2B:
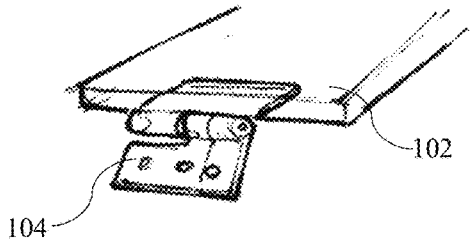
Figure 2C:
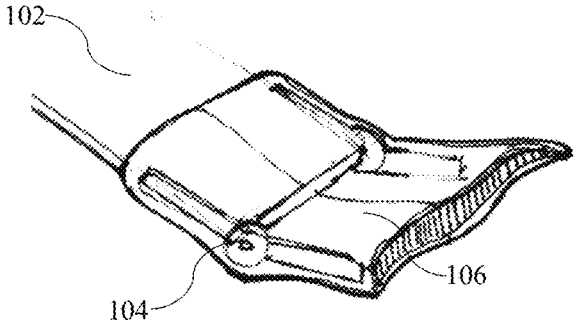
Figure 2D:
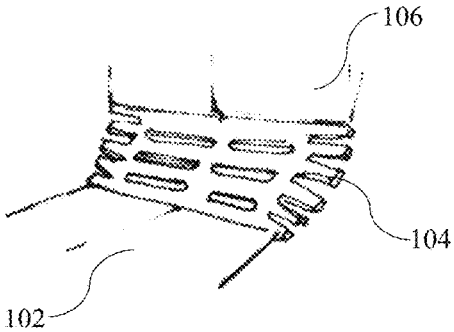
Figure 2E:
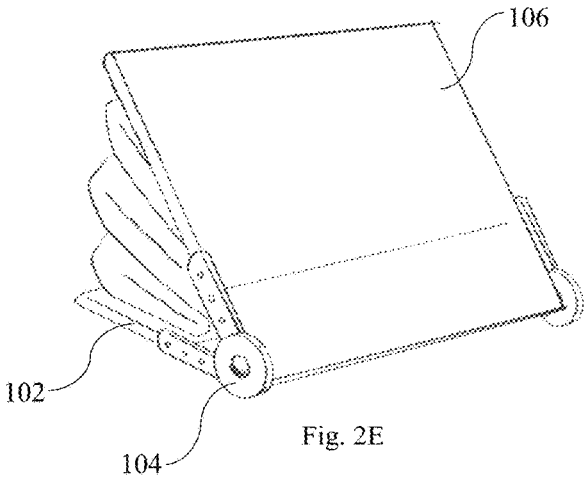
Figure 2F:
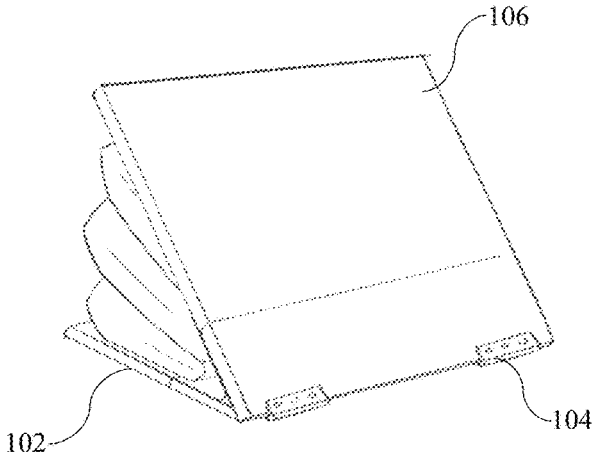

FIGS. 2A-2F show some possible embodiments for the hinge element 104. For example, in FIG. 2A, shows a butt hinge that may be used as the hinge element 104. In this embodiment, the hinge element 104 may be placed at one end of the base 102 and connected to one end on the adjustable support 106. In another embodiment, as shown in FIG. 2B, the hinge element 104 may be a flag hinge that may be connected to one end of the base 102 and connected to one end of the adjustable support 106. The hinge element 104 is a means that may allow the adjustable support 106 to transition rotationally with respect to the base 102. Another embodiment is shown in FIGS. 2C and 2E, here the hinge element 104 is depicted as a plurality of knife hinges, placed near one longitudinal end of both the base 102 and the adjustable support 106. The hinge element 104 may connect to both the base 102 and the adjustable support 106 on the side. Another embodiment is shown in FIG. 2D, here the hinge element 104 may be a living hinge formed out of any rigid material with sufficient elasticity that would allow the adjustable support 106 to rotate with respect to the base 102. For example, the hinge element 104 may be formed out of methyl methacrylate (such as Plexiglas), polyvinyl chloride ("PVC"), or any other rigid property that has similar properties. In yet another embodiment the hinge element 104 may be a plurality of piano hinge, as shown in FIG. 2F. The hinges shown in FIGS. 2A-2F are only possible embodiments of the hinge element 104. In addition, the possible hinges shown in FIGS. 2A-2F, the hinge element 104 may be a take and elbow hinge or an extruded PVC hinge. We believe that an extruded PVC hinge would be the best mode for the hinge element 104.

Figure 3A:
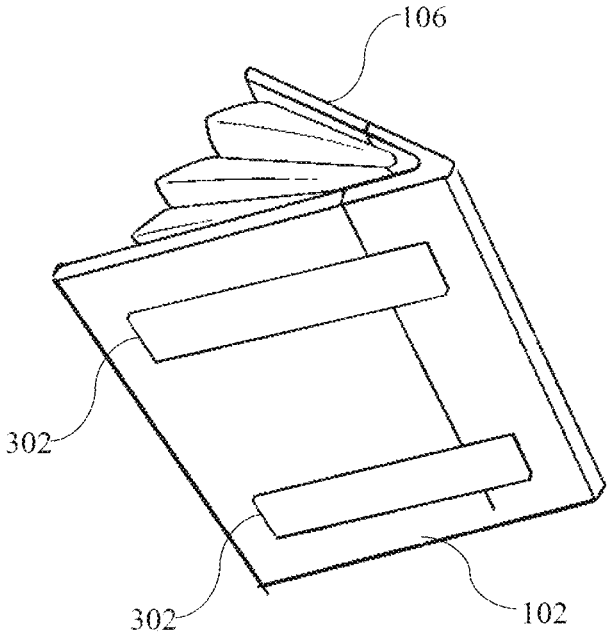
FIGS. 3A and 3B illustrate several embodiments of the present disclosure, featuring a slip resistant element.
Figure 3B:
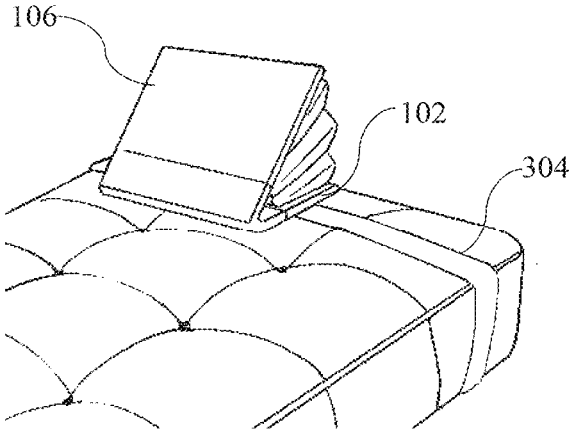

The embodiments may also include a slip resistant element 302. FIG. 3A shows one embodiment of the slip resistant element 302. In this embodiment, the slip resistant element 302 may be formed of a flexible material with a coarse texture similar to the hook of a hook and loop fastener, such as Velcro® fastener, that may interact with the bed through a friction engagement as to prevent the base 102 from moving or sliding with respect to the surface on which it is resting. In another embodiment, FIG. 3B shows the slip resistant element 302 as a strap that may be connected to the bottom of the base 102. The slip resistant element 302 may be connected directly to the base through an adhesive or mechanical connection, or it may interact with the base through a hook and loop engagement. The strap may then be placed around the mattress on which the embodiment is placed as a means to prevent the embodiment from moving or sliding.

Figure 4A:
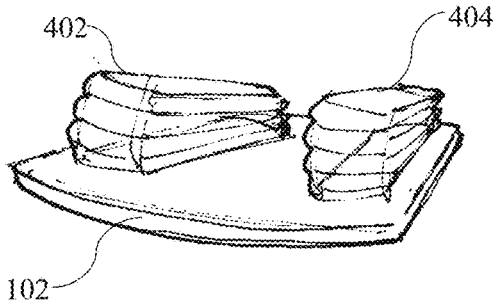
FIGS. 4A, 4B, 4C, 4D, and 4E illustrate different embodiments of the present disclosure, including different embodiments for the inflatable bladder.
Figure 4B:
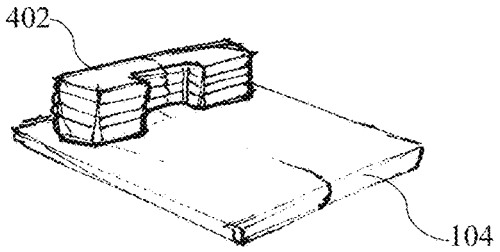
Figure 4C:
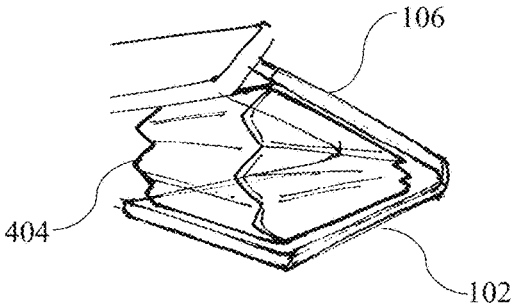
Figure 4D:
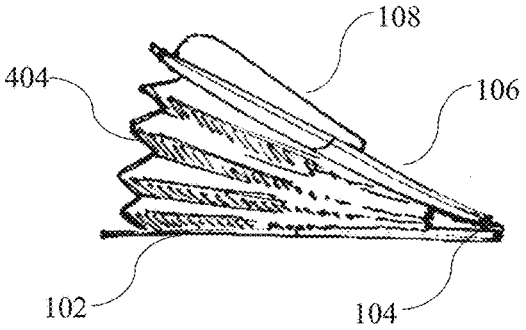
Figure 4E:
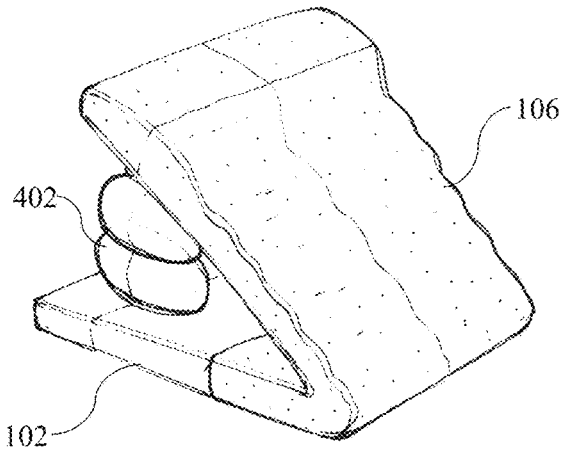

In between the base 102 and the adjustable support 106 may be placed an inflatable bladder 402. In one embodiment, the inflatable bladder 402 may be a plurality of inflatable bladders, as shown in FIG. 4A. However, in another embodiment the inflatable bladder 402 may be one inflatable bladder as shown in FIG. 4B. In either embodiment, the inflatable bladder may be connected to the base 102 and the adjustable support 106. The inflatable bladder may inflate with air as a means to cause the adjustable support 106 to rotate with respect to the base 102. As the inflatable bladder 402 is inflated, the incline angle for the adjustable support may vary from zero degrees up to ninety degrees, or more if necessary. The inflatable bladder 402 may be enclosed within a ribbed covering 404. For example, in the embodiment shown in FIGS. 4C and 4D, the inflatable bladder may be enclosed in a ribbed covering 404. Also, the inflatable bladder 402 and the ribbed covering 404 may be conflated, as shown in FIGS. 4C and 4D, into a single element wherein the inflatable bladder 402 may not be the ribbed covering 404. If the inflatable bladder 402 is the shape of the ribbed covering 404, then the inflatable bladder may be divided into a plurality of sections. In any of the embodiments, the inflatable bladder 402 and the ribbed covering 404 may be formed of PVC or any other material with similar properties. FIG. 4E shows another embodiment of the inflatable bladder 402.

Figure 5A:
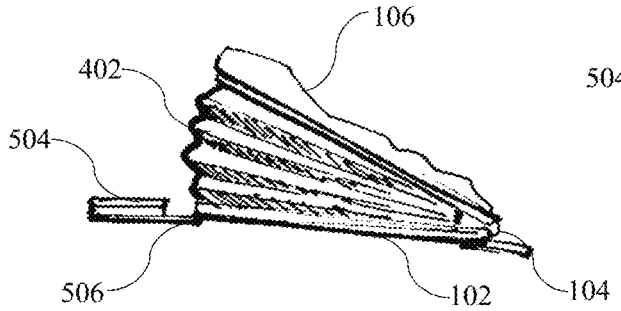
FIGS. 5A, 5B, 5C, 5D, 5E, and 5F illustrate different embodiments of the present disclosure, featuring an inflator support with a hinge element, inflator, and a strap to secure the device closed.
Figure 5B:
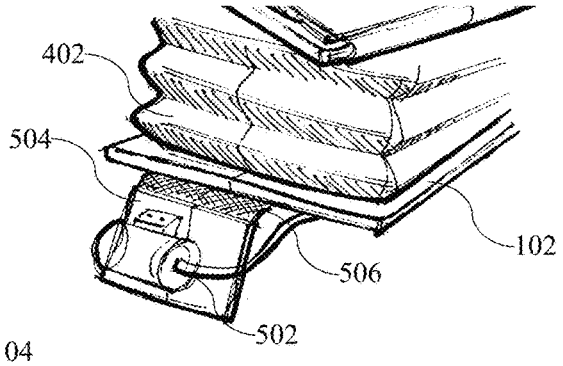
Figure 5C:
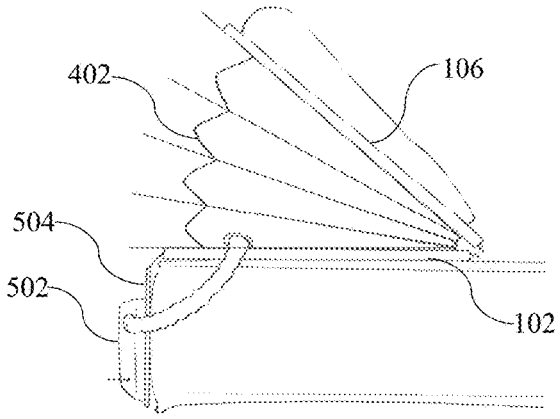

An inflator 502 may be connected to the inflatable bladder 402 as a means for inflating the inflatable bladder 402. In one embodiment, the inflator may be placed outside the ribbed covering 404 on an inflator support 504, as shown in FIGS. 5B, 5C, and 5F. In another embodiment, the inflator 502 may be placed with in the ribbed covering 404. In yet another embodiment, the inflator 502 may be separate and be placed on another surface, such as on the ground or underneath the user's bed, or any other location the user chooses. The inflator support 504 may be connected to the base 102 with a flexible link 506. The inflator support 504 may be connected to the base 102 in such manner that when the base 102 is placed on a mattress, the inflator support may hang over the side of the mattress as shown in FIG. 5F or on the left or right side of the mattress. The inflator support 504 may be formed of a similar material to the base 102. With the flexible link 506 also may be formed of the variety of hinges that comprise the hinge element 104 or it may be a material similar to a hook and loop fastener. The inflator 502 may be any electric air pump, like a rotary lobe pump, a diaphragm pump, a gear pump, or a pump similar to inflator pump for the Select Comfort® Sleep Number® system, developed by Sleep Number Corporation, operated via wired or wireless remote control that may indicate to the user the angle number to which the user is being adjusted. The inflator 502 may be connected to the inflatable bladder 402 through one or more hoses, as shown in FIG. 5B-5E. It should be noted that a mobile app of a mobile device can be used to control the inflator, as well as display or otherwise indicate the angle number of the adjustable support member.

Figure 5D:
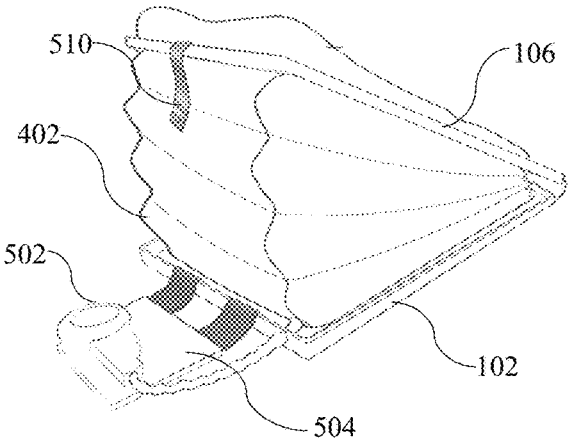
Figure 5E:
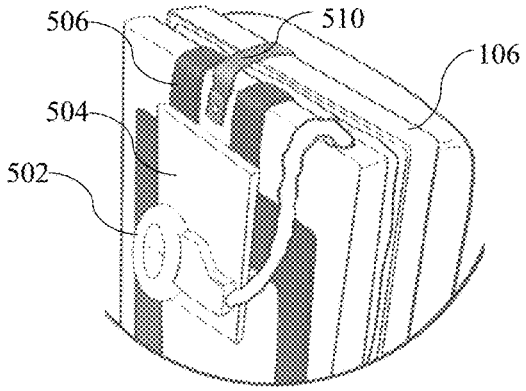
Figure 5F:
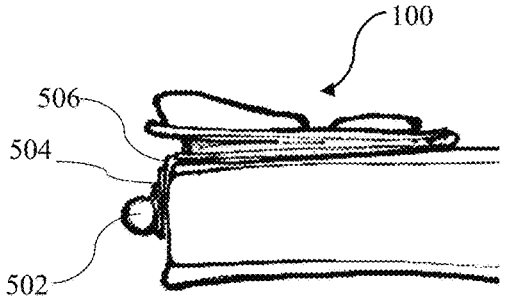

FIGS. 5D and 5E also show a close strap 510 that may be placed with one end on either the adjustable support 106 or the base 102. The close strap 510 may be placed on the opposite end of the base 102 or the adjustable support 106 as the hinge element 104. The close strap 510 may engage with the other element through a clasp, or other similar engagement, as a means of securing the embodiment closed. For example, if the close strap 510 is connected to the adjustable support 106 through an adhesive or mechanical engagement, then the close strap may engage with a clasp on the base 102 so as to secure the embodiment in the closed position.

Figure 6:
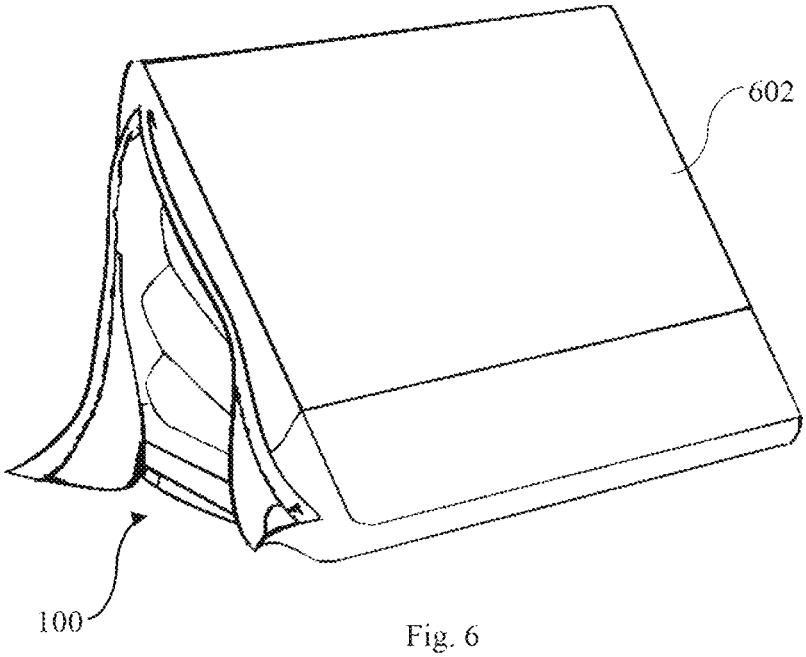
FIG. 6 illustrates one embodiment of the present disclosure, featuring an exterior cover for the device.

FIG. 6 shows an exterior cover 602 may be used to enclose the embodiment. The exterior cover 602 may be formed of fabric, elastic fabric, or other similar materials, and may have a variety of properties. Such as, the exterior cover 602 may be anti-microbial, it may be formed of bamboo, or the exterior cover may be hypoallergenic. Further, the exterior cover 602 may be formed to include elastic elements 604 that may be used to ensure that the exterior cover 602 maintains a close engagement to the embodiment. In addition, a pocket (not illustrated) may be formed directly into the exterior cover 602, or it may be separate and connected to the base 102 or the adjustable support 106 through an adhesive, mechanical, or similar engagement.

FIGS. 7A-7D illustrate various views of a support device 700 with a frame 702, hinge elements 704, and an inflatable bladder 708 in accordance of various embodiments of the present disclosure. The frame 702 includes a base member 720 and an adjustable support member 722 with a pad 706 on a top side of the adjustable support member 722. Two hinge elements 704 (also referred to as just hinges) are coupled to a first side of the base member 720 and a first side of the adjustable support member 722. In other embodiments, more or less hinges 704 can be used to allow the adjustable support member 722 to rotate about an axis at the first side of the base member 720 and the adjustable support member 722. The inflatable bladder 708 is coupled between a section of the base member 720 and a section of the adjustable support member 722. The section of the base member 720 is located closer to a second side of the base member 720 than the first side of the base member. The section of the adjustable support member 722 is located closer to a second side of the adjustable support member 722 than the first side of the base member 720. The inflatable bladder 708 includes an outer wall, an inner wall, and multiple ribs 710 coupled between the outer wall and the inner wall. The ribs 710, the outer wall, and the inner wall form multiple inflatable chambers of the inflatable bladder 708. A chamber can contain air or other liquids (or gases) that by its elasticity equalizes the pressure and flow of liquid or air in the system. Each of the ribs 710 include at least one planar port 712. The planar ports 712 allow air to pass from one chamber to another chamber. The ribs 710 and the planar ports 712 allow the inflatable chamber to increase and decrease in pressure, while maintain the structure of the support device 700. As the inflatable chambers fill with air, the internal pressure of the inflatable bladder 708 increases. As the internal pressure of the inflatable bladder 708 increases, the internal pressure of the inflatable bladder 708 causes the adjustable support member 722 to rotate about the hinge elements 704, increasing an angle between the base member 720 and the adjustable support member 722. Similarly, as the internal pressure of the inflatable bladder 708 decreases, the internal pressure causes the adjustable support member 722 to rotate about the hinge elements 704, decreasing the angle between the base member 720 and the adjustable support member 722.

As illustrated, the support device 700 includes a pump assembly 714, including at least one pump. The pump of the pump assembly 714 is coupled to an inlet 716 and an outlet 718 of the inflatable bladder 708. The pump is configured to increase or decrease the internal pressure of the inflatable bladder 708. The inflatable bladder 708 is configured to cause the adjustable support member 722 to rotate about the hinge element(s) 704 as the internal pressure of the inflatable bladder 708 increases or decreases. The inflatable bladder 708 is configured to cause the adjustable support member 722 to transition relative to the base member 720 using the hinge element(s) 704.

In one embodiment, when the pump increases the internal pressure, such as from a first amount to a second amount, a first chamber of the multiple chambers inflates to a substantially filled state before a second chamber inflates. The first chamber is closer to the section of the base member 720 than the second chamber. When the pump increase the internal pressure from the second amount to a third amount, the second chamber inflates to a substantially filled state before a third chamber inflates, the second chamber being closer to the section of the base member 720 than the third chamber. This may continue until all the chambers are inflated to a substantially filled state. Similarly, as the pump (and/or the valve system) is controlled to decrease the internal pressure, a last chamber deflates to a substantially deflated state before a next chamber deflates. For example, the third chamber can deflate first, then the second chamber, and then the first chamber.

In one embodiment, the inflatable bladder 708 includes three sections: a middle section having a first length between the inner wall and the outer wall; a first side section having a second length between the inner wall and the outer wall, the second length being greater than the first length; and a second side section having the second length between the inner wall and the outer wall. In a further embodiment, the inflatable bladder 708 has a U-shape. In some embodiments, at least a portion of the pump assembly 714 is disposed within an outer perimeter of the U-shape. For example, the pump is disposed in area on the base member 720 defined by a third length between the outer wall of the first side section and the outer wall of the middle section and a width of the middle section. In one embodiment, the pump assembly 714 includes a pump, a valve system, a power supply, an alternating current (AC) to direct current (DC) (AC/DC) converter, a relay coupled to the pump, a set of MOSFETS, each MOSFET of the set being coupled to a valve of the valve system, a microcontroller coupled to the power supply, the AC/DC converter, the relay and the set of MOSFETs. It should be noted that the AC/DC converter can be certified for medical use in some instances. The microcontroller is configured to control the valve system via the set of MOSFETs and the pump via the relay. For example, the relay can be used to turn on/off the motors of the pump. Alternatively, other switches can be used to control the valve system.

Additional details of the pump assembly 714 are described below with respect to FIG. 9.

Figure 7C:
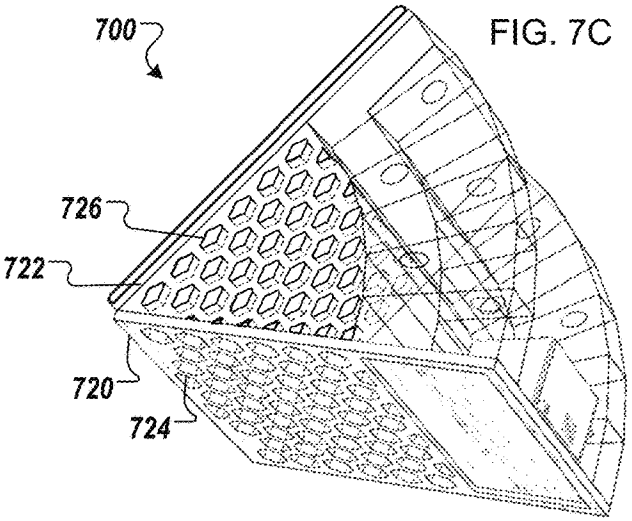
FIGS. 7A-7D illustrate various views of a support device with a frame, hinge elements, and an inflatable bladder in accordance of various embodiments of the present disclosure.
Figure 7D:
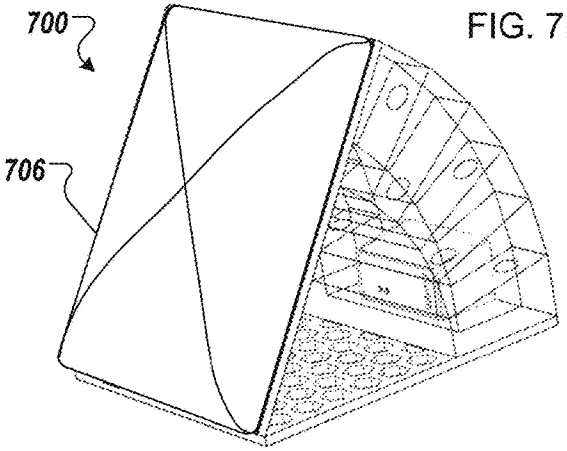
Figure 7A:
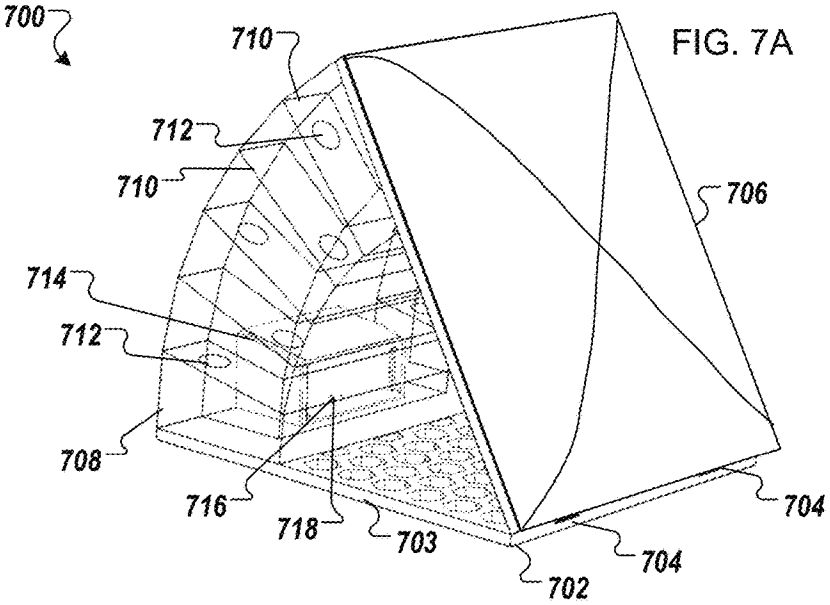
Figure 7B:
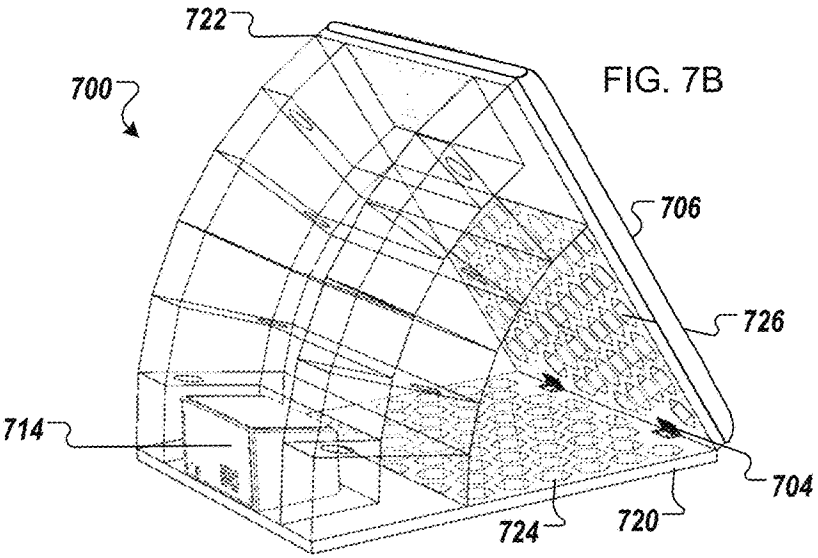

In another embodiment, the pump is coupled to the inflatable bladder 708 via a valve system (not illustrated in FIGS. 7A-7B). The valve system can be a 4-way, 5-port valve system as described in more detail with respect to FIGS. 10-11.

In one embodiment, the base member 720 includes multiple cutouts 724 to reduce an overall weight of the base member 720 while maintain structural integrity of the base member 720. Similarly, the adjustable support member 722 includes multiple cutouts 726 to reduce an overall weight of the adjustable support member 722 while maintaining structural integrity of the adjustable support member 722. In one embodiment, the cutouts 724, 726 are circular. In another embodiment, the cutouts 724, 726 are other shapes, such as pentagons, hexagons, octagons, or other polygons.

The base member 720 and the adjustable support member 722 can be two hard or rigid pieces that are joined at the front with one or more hinges 704. The base member 720 and the adjustable support member 722 can be any durable material, including MDF, Polypropylene, polycarbonate, or other off-the-shelf plastics, which are lightweight and rigid. The cutouts 724, 726 can be hexagon shapes, instead of round house, and can be machined out using various tools, including a CNC machine. Some areas of the base member 720 can be free of the cutouts 724 to accommodate at least a portion of the pump assembly 714. In other embodiments, the base member 720 and the adjustable support member 722 can be composite plastics, manufactured as mold injection types, or other backing materials. The materials selected can determine a weight and profile of the base member 720 and the adjustable support member 722. For example, the base member 720 and the adjustable support member 722 can have a thickness of ¾ inch. Alternatively, the thickness can be ⅜ inch or ½ inches. Alternatively, other thicknesses can be used for the base member 720 and the adjustable support member 722. The frame 702 can include one or more handles for portability. The pad 706 can be coupled to a top side of the adjustable support member 722. The pad 706 can be high density foam of various dimensions. In one embodiment, the pad 706 has a height of 3 inches that tapers down to 1 inch at the edges of the pad 706. The tapering of the pad 706 can reduce transitions of the user on a bed or pillow. The high density foam of the pad 706 can be glued to the adjustable support member 722 and the foam can be covered by a sleeve or other coating. The coating can be removable to facilitate cleaning of the cover. In other embodiments, the pad 706 can be upholstered and an outside sleeve can cover the upholstery. The sleeve can be removable for cleaning and can be replaced, since the sleeve can break down before the upholstery padding can be configured for a longer use.

There are several variations of hinges that can be used, including loop hinges, standard flat hinges, compound hinges, or the like. The flat hinges can provide a simple design with high strength for lateral stresses. For example, the lateral stress per hinge 704 can accommodate well over 600 pounds in traversal forces.

It should be noted that the frame 702 can include folding backings or telescoping backings. For example, a higher-end model could include telescoping backings to adjust a height of the adjustable support member 722, the base member 720, or both. Given the more complex design, additional tooling and manufacturing may be needed for the telescoping backings.

As set forth in the various embodiments here, the support device 700 can be a portable device that can be situated on a bed or other horizontal surface. The support device 700 can be a compact design, lightweight, and sturdy to support a patient, as well as lift the patient from a horizontal position on the bed or other surface to an inclined position. The movement of the support device 700 is such that the patient sits up in an exercise-crunch like motion. The movement of the support device 700 can also be controlled to change an angle of inclination of the patient on the bed or other surface.

In another embodiment, the inflatable bladder 708 is incorporated into the frame, such as in sections in the base member 720 and the adjustable support member 722. These sections can be recessed sections that prevent the inflatable bladder 708 from slipping. The inflatable bladder 708 can be various materials, but can include anti-microbiotical materials, such as Thermoplastic polyurethane (TPU) material. The TPU material can be flexible, but allow cleanliness and strength. For example, the inflatable bladder 708 can have a thickness of 0.03 inches of TPU material. In other embodiments, the thickness can be 0.015 inches of TPU material. Alternatively, other materials can be used for the inflatable bladder 708. The material of the inflatable bladder 708 can be clear, opaque, or solid colors. In one embodiment, the inflatable bladder 708 is manufactured by heat pressing seems between adjoining sections, such as the ribs 710 between the inner and outer walls. The edges of the walls can also be heat pressed. For example, a roller heat sealer can be used to heat seal the seams of the inflatable bladder 708. In another embodiment, an ultrasonic sealer could also be used to seal the seams. Alternatively, other manufacturing techniques can be used to construct the inflatable bladder 708.

Various embodiments described herein provide solutions of the inflatable bladder, including an airbladder in the shape of a wedge with two hard pieces on the outside with a basic hinge in front of the two pieces to pivot the two hard pieces. The pump assembly can be integrated within a portion of the inflatable bladder for compactness and portability of the support device. In an effort to keep the shape of the airbladder, keeping the airbladder from extending beyond the width of the frame, the airbladder can include multiple ribs as planar layers of the airbladder. Using planar ports, a systematic airflow of the airbladder includes air going through the airbladder from one chamber to another. The airbladder sits flat with the multiple chambers deflated. When the airbladder is inflated, each chamber inflates one chamber at a time. By inflating one chamber at a time, the airbladder is able to maintain its shape from extending beyond the width of the frame and strengthens the airbladder itself under a load. The airbladder between the two hard pieces provides support for the patient before, during, and after the airbladder is inflated or deflated between various angles between the two hard pieces. Additional details of the air flow are described below with respect to FIG. 8.

Figure 8A:
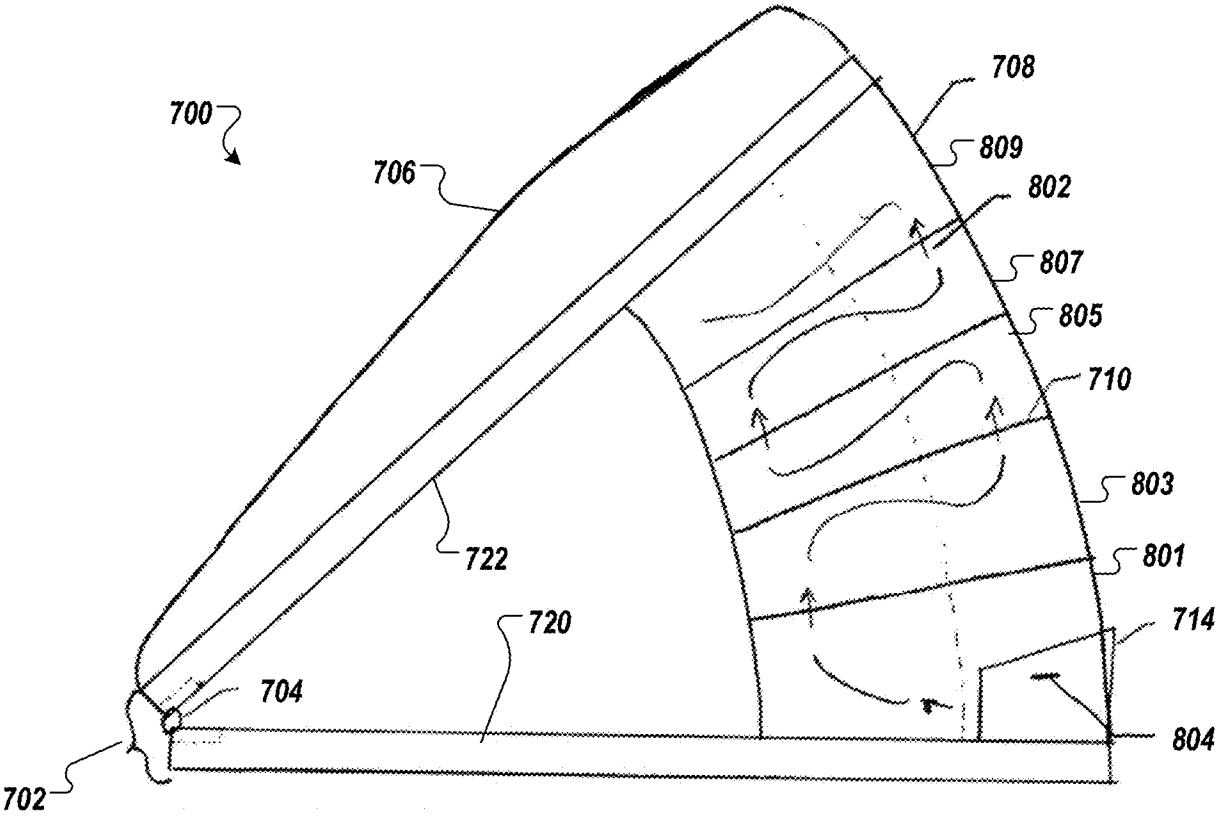
FIG. 8A illustrates a side view of a support device with a frame and an inflatable bladder with multiple ribs with planar ports in accordance of various embodiments of the present disclosure.
Figure 8B:
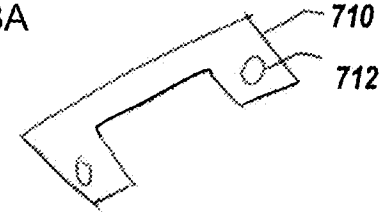
FIG. 8B illustrates a rib of the inflatable bladder, the rib having planar ports in accordance of various embodiments of the present disclosure.

FIG. 8A illustrates a side view of the support device 700 with the frame 702 and the inflatable bladder 708 with multiple ribs 710 with planar ports 712 in accordance of various embodiments of the present disclosure. FIG. 8B illustrates a rib of the inflatable bladder, the rib having planar ports in accordance of various embodiments of the present disclosure. As described above, the pump assembly 714 can include a microcontroller 804 to control a pump. The microcontroller 804 can be a Beetle BLE microcontroller that support Bluetooth® Low Energy (BLE) technology to communicate with a remote, with a client device (e.g., an app executing on a mobile device), or other external devices.

During operation, the pump inflates the inflatable bladder 708 with air under the controller of the microcontroller 804. The microcontroller 804 can also control a valve system to deflate the inflatable bladder 708. When the inflatable bladder 708 starts from a deflated state, the pump inflates a first chamber 801 of the inflatable bladder 708 by increasing an internal pressure of the inflatable bladder 708, which starts to inflate the first chamber 801. When the first chamber 801 is in a filled state or a substantially filled state, the pump starts to inflate a second chamber 803. When the second chamber is in a filled state or a substantially filled state, the pump starts to inflate a third chamber 805. When the third chamber is in a filled state or a substantially filled state, the pump starts to inflate a fourth chamber 807. When the fourth chamber is in a filled state or a substantially filled state, the pump starts to inflate a fifth chamber 809. The pump can stop inflating the inflatable bladder 708 when the fifth chamber is in a filled state or a substantially filled state. The placement of the planar port(s) 712 in a first rib above the first chamber 801, the planar port(s) 712 in a second rib above the second chamber 803 cause an air flow 802. The airflow 802 extends through a chamber in a first direction towards the inner wall of the inflatable bladder, passes through the planer port 712, and extends through a next chamber in a second direction (opposite direction than the first direction) towards the outer wall. In the next chamber, the air flow 802 passes through another planer port 712 and extends through a second next chamber in the first direction back towards the inner wall, and so on and so forth. Similarly, when the inflatable bladder 708 deflates, the air flow 802 may be reversed.

Figure 9A:
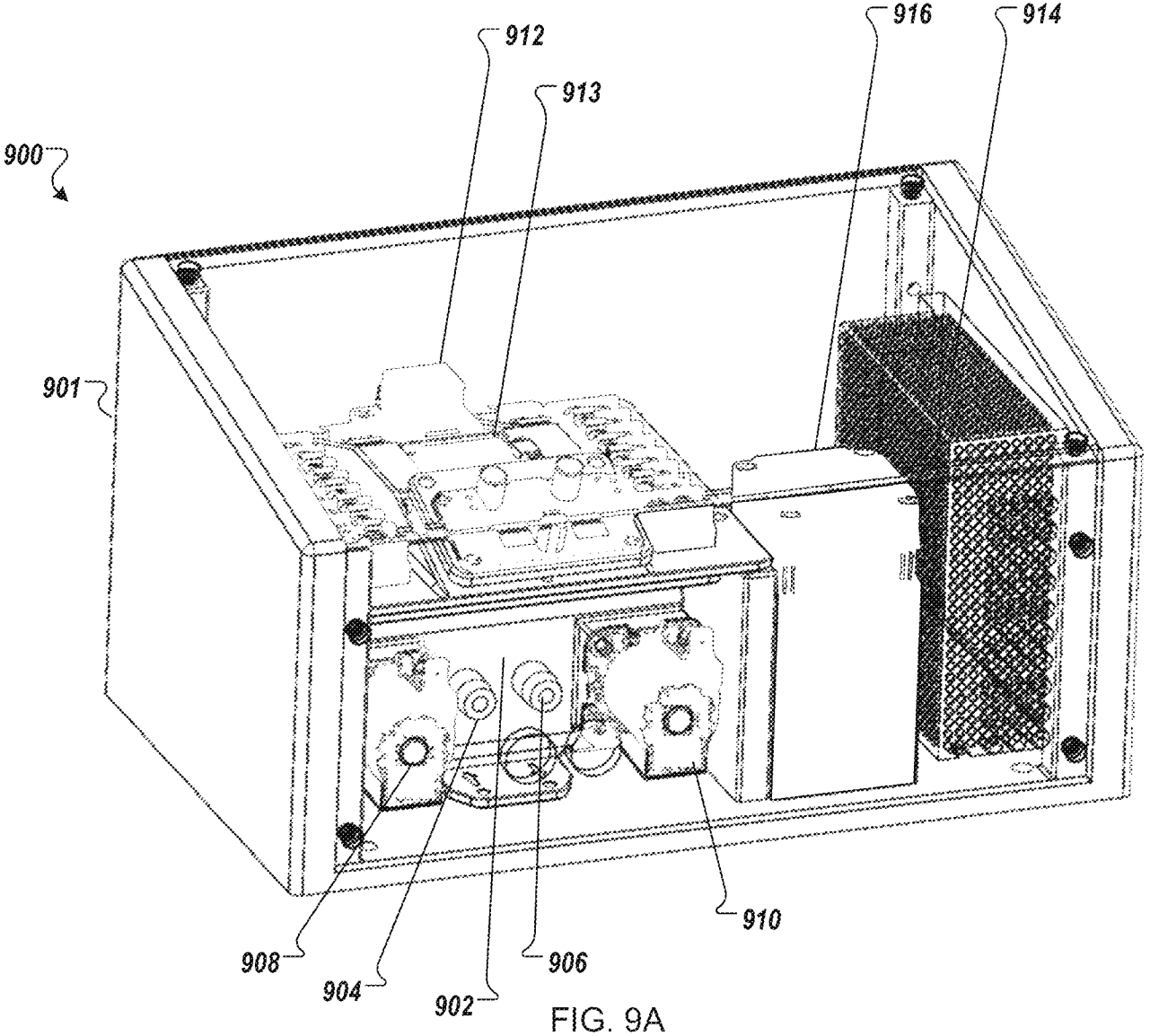
FIGS. 9A-9B illustrates a pump assembly of an adjustable support device in accordance of various embodiments of the present disclosure.
Figure 9B:
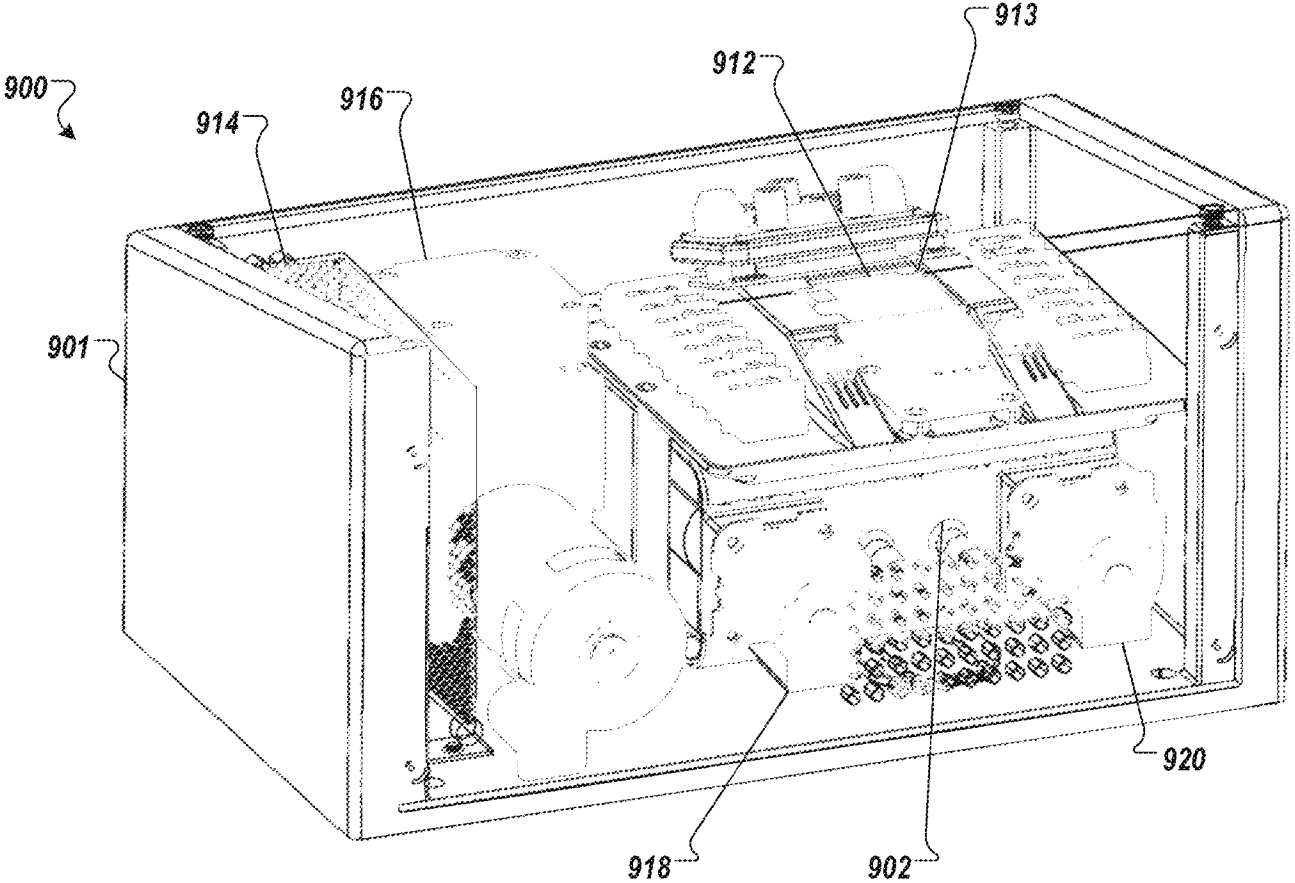

FIG. 9 illustrates a pump assembly 900 of an adjustable support member device in accordance of various embodiments of the present disclosure. The pump assembly 714 can correspond to the pump assembly 714 of FIG. 7. The pump assembly 900 includes a housing 901 in which multiple components of the pump assembly 900 reside. The housing 901 can include rubber or rubber-like material in order to reduce noise from the pump assembly 900. Alternatively, or in addition to the housing's material, noise-reduction material can be placed on the inside of the housing 901 to reduce noise. The pump assembly 900 can include a valve system 902, including an inlet 904 and outlet 906. The inlet 904 and outlet 906 can be connected to tubes that connect to the inlet and outlet of the inflatable bladder. The valve system 902 includes multiple four solenoid valves (908, 910 illustrated in FIG. 9A and 918, 920 illustrated in FIG. 9B). A solenoid valve is an electromechanical device in which the solenoid uses an electric current to generate a magnetic field and thereby operate a mechanism which regulates the opening of fluid flow (e.g., air) in a valve. The valve system 902 is described in more detail with respect to FIGS. 10-11.

The pump assembly 900 also includes a relay 912 coupled between a microcontroller 913 and a pump 916. Various components of the pump assembly 900 can be powered by a power supply 914. The pump assembly 900 can also include an AC/DC converter that converts AC to DC for the power source. The power supply 914 can provide a first voltage rail, such as 12V power rail. The pump assembly 900 can also include a step-down converter (e.g., buck converter). The step-down converter is a DC-to-DC power converter which steps down voltage from a first voltage to a second voltage. The step-down converter can be used to convert the first voltage rail, such as the 12V power rail, to a second voltage rail, such as 5V. Some components can be powered by the first voltage rail and other components can be powered by the second voltage rail. The pump assembly 900 includes a set of switches (not labeled in FIGS. 9A-9B), such as MOSFETS, to control the solenoid valves (e.g., 908, 910 and two other solenoid vales on the opposite side of the valve system 902. Each MOSFET of the set is individually coupled to a valve of the valve system 902. The microcontroller 913 is coupled to the power supply 914 via the first voltage rail, the relay 912, and the set of MOSFETs, The microcontroller 913 is configured to control the individual valves of the valve system 902 via the set of MOSFETs. The microcontroller 913 is configured to control the pump 916 via the relay 912. Alternatively, other types of switches can be used to control the valve system 902. In one embodiment, the microcontroller 913 can communicate with other devices wirelessly, for example, using the BLE or Bluetooth® standards. The other devices can be a wireless remote control device, a mobile device, such as using an app on the mobile device, or the like. The wireless remote control device can be a device with standard size batteries for the battery source can include corresponding wirelessly technology to communicate with the microcontroller 913 to control operations of the support device. For example, the remote functions can include, up, stop, down, inflate to a specific angle, deflate to a specific angle, power on, power off, or the like.

In one embodiment, the pump assembly 900 can operate with a power input of 120V 60 Hz, AC. The pump assembly 900 can provide two internal voltages of 12V DC and 5V, such as by using a DC/DC step-down converter. The AC/DC converter can be 12V 5 amp power converter and can be certified for medical use. The microcontroller 913 can be the DF Robot Beetle BLE microcontroller. The valve system 902 can include four solenoid valves and the pump 916 can operate at 40 liters/minute (L/min) at 1 PSI. The pump assembly 900 can be designed to weight about 5 pounds (lbs) with dimensions of 10"×6"×5.5". Alternatively, other weights and dimensions are possible. The pump assembly 900 can also include an on/off switch to power on and off the electronics. In one embodiment, the inlet 904 and outlet 906 can be quick connects, such as ⅜" quick connects. The pump connections can be ¼" hose barbs and the bladder connections can be ⅜" hose slip on with crimps. The air connections can be opened and non-controlled.

In one embodiment, the support device and pump assembly can be integrated into a product unit. The product unit can have a total weight of 25 lbs. The product unit can also be lower weights, such as 10-20 lbs. The product unit can have dimensions of 24"×30", but could also be other dimensions such as 23"×29". The product unit can have a maximum height of 28.5 when at a maximum angle between the base member and the adjustable support member. The product unit can have a minimum height of 12" when at a minimum angle. In other embodiments, the minimum height can be between 5" and 10". An angle of the product unit can be adjusted between 10 to 60 degrees. Alternatively, other angles can be achieved.

Figure 10:
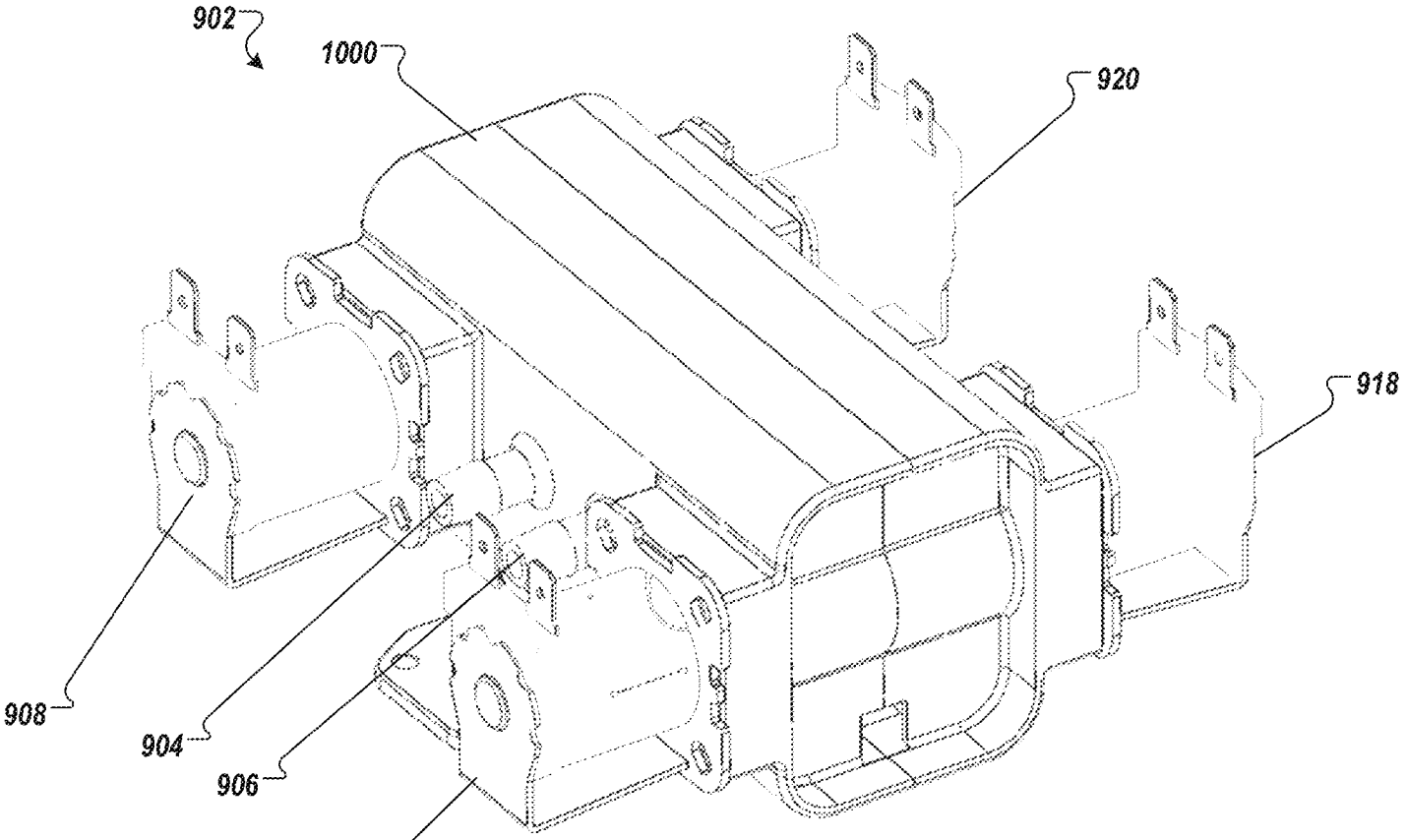
FIG. 10 illustrates a valve system in accordance of various embodiments of the present disclosure.
Figure 11:
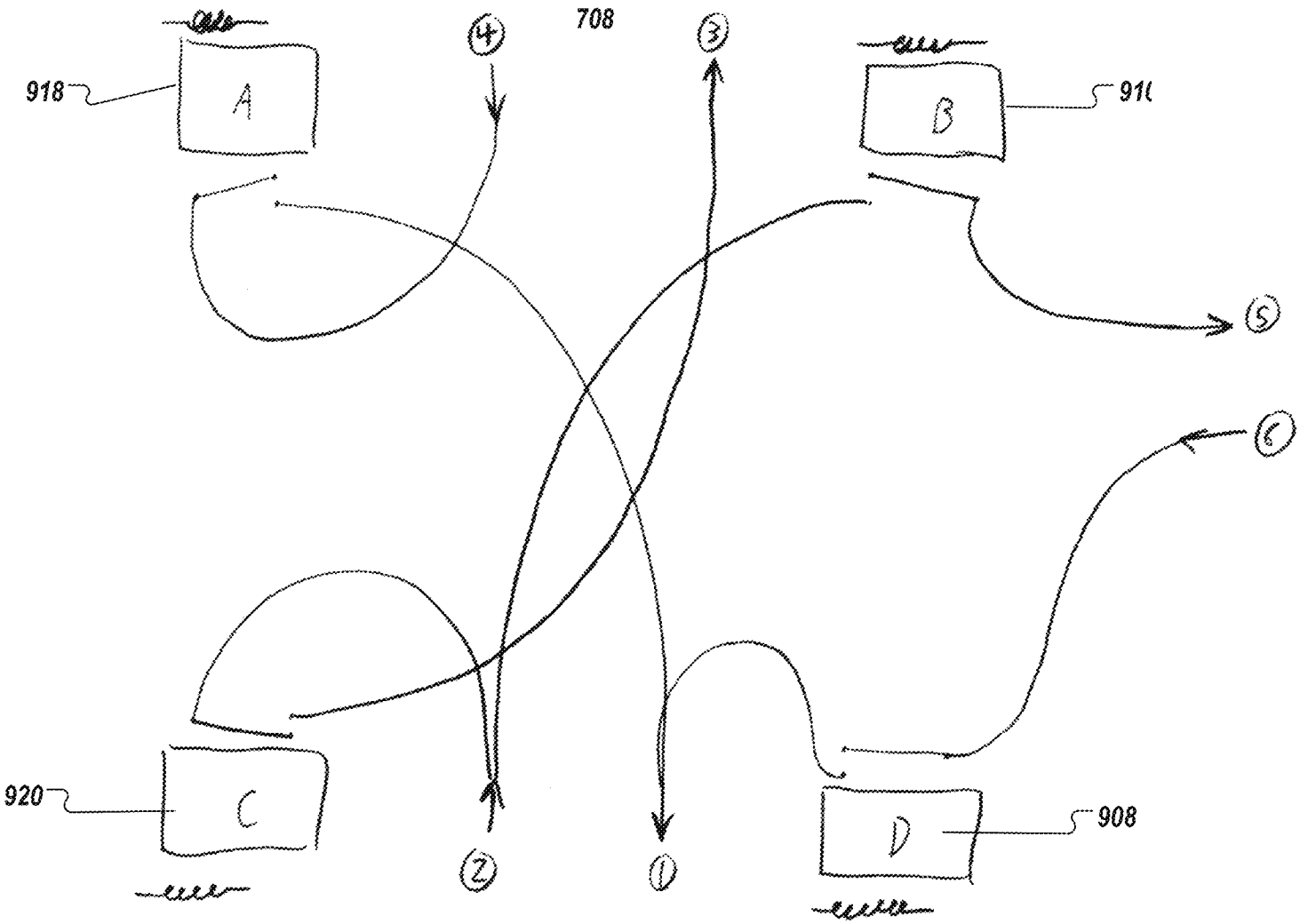
FIG. 11 illustrates multiple airflow paths of the valve system of FIG. 10 in accordance of various embodiments of the present disclosure.

As described herein, the pump assembly 900 includes the valve system 902, which is described in detail with respect to FIGS. 10-11.

FIG. 10 illustrates the valve system 902 of FIG. 9 in accordance of various embodiments of the present disclosure. The valve system 902 includes a valve assembly manifold 1000 with the inlet 904, the outlet 906, and multiple internal chambers. Airflow for each internal chamber is controlled by one of the solenoid valves 908, 910, 918, and 920. The valve system 902 can be considered a 4-way, 5-port valve system that can handle low pressure situations. The valve system 902 can be used to inflate and deflate the inflatable bladder. The airflow in and out of the inflatable bladder can be controlled using the four solenoid valves 908, 910, 918, and 920. The solenoid valves 908, 910, 918, and 920 can be controlled as four separate actions to control the direction of the airflow, etc. The airflow within the valve system 902 is illustrated and described with respect to FIG. 11.

FIG. 11 illustrates multiple airflow paths of the valve system of FIG. 10 in accordance of various embodiments of the present disclosure. Each solenoid valve 908, 910, 918, and 920 are labeled D, B, A, C, respectively. The in/out connections are labeled 1, 2, 3, 4, 5, and 6. The valve system 902 is based off of the inlet and outlet flow. When actuating the A/B solenoid valves (918, 910) on, air is transferred from the inflatable bladder 708 into the pump 916, out of the pump 916 and into the air environment. When the C/D solenoid valves (920, 908) on, air is transferred from the air environment into the pump 916, out of the pump 916 and into the inflatable bladder 708. As part of the process for the deflation of the inflatable bladder 708, the A/B solenoid valves are actuated down, utilizing connections 1, 2, 3, and 5. As part of the process for the inflation of the inflatable bladder 708, the C/D solenoid valves are actuated up, utilizing connections 1, 2, 3, and 6.

In one embodiment, the inflatable bladder 708 can be inflated while maintaining 1-2 PSI for optimal pump output and the pump can accommodate the type of volume. The valve system 902 can also be used to deflate the inflatable bladder 708 faster, since natural air pressure may not release air fast enough from the inflatable bladder 708.

As described herein, the pump 916 can be a 40-liter/min pump that operates 12V. The inlet and outlet of the inflatable bladder can be coupled to the valve assembly manifold 100 and the microcontroller 913 can control the four solenoid valves to pump air in and out of the inflatable bladder 708. More specifically, the four solenoid valves can be used to control air flow from cavities of the valve assembly manifold 1000 from area to area. The pump and the valve system can be controlled by the microcontroller. The connections from the pump to the value assembly manifold 1100 can use ¼ inch barbed fittings for the pump and the connections from the valve assembly manifold 1000 to the inflatable bladder 708 can use ⅜ inch slip-on hose fittings, meant to use with crimps on the outside (crimp tool). The hoses between can be flex hoses and can have ⅜ inch quick connections. The inflatable bladder 708 can use ⅜" valves. When the quick connects are unplugged, the air is unable to escape through the quick connects. This can allow the user to unplug and plug in an easy manner.

Figure 12:
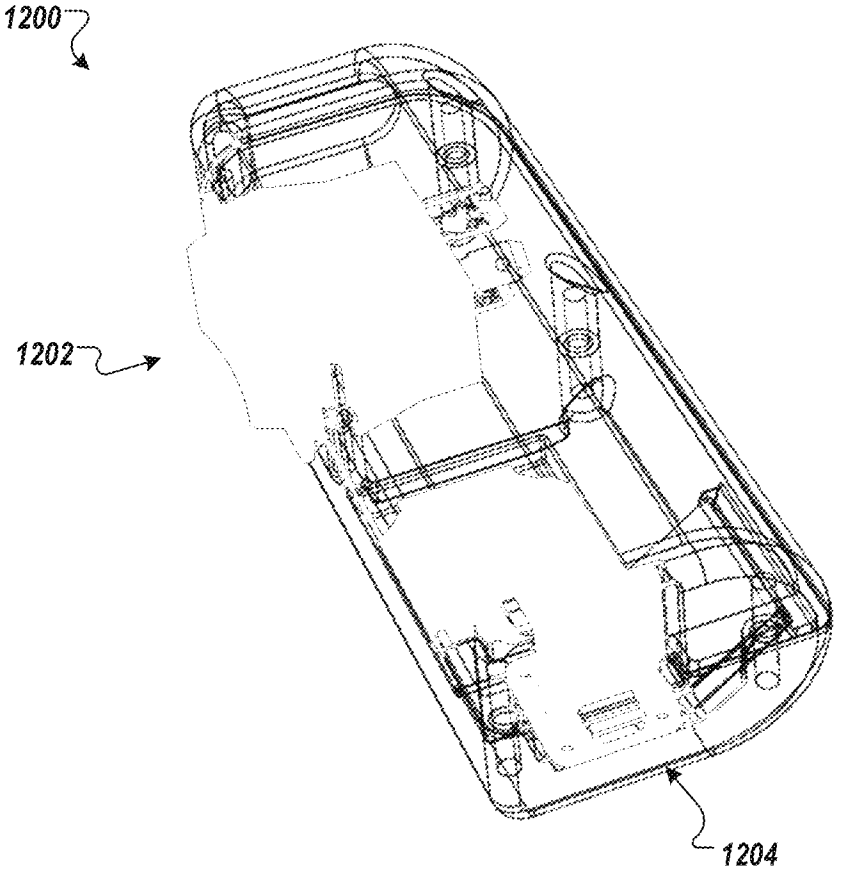
FIG. 12 illustrates a wireless remote control device in according with embodiments of the present disclosure.

FIG. 12 illustrates a wireless remote control device 1200 in according with embodiments of the present disclosure. The wireless remote control device 1200 can include various switches, buttons, or other controls. As illustrated, the wireless remote control device 1200 includes an up/down toggle switch 1201. When at rest, the up/down toggle switch 1202 does not move the adjustable support member device. When toggled to a first position, the up/down up/down toggle switch 1202 controls the adjustable support member device to increase an angle of inclination. When toggled to a second position, the up/down toggle switch 1202 controls the adjustable support member device to decrease the angle of inclination. The wireless remote control device 1200 also includes a power switch 1204. The wireless remote control device 1200 includes a microcontroller with wireless capabilities to wirelessly communicate control signals or information to the microcontroller of the adjustable support member device. Alternatively, a wired remote control device can be integrated and coupled to the pump assembly to control the adjustable support member device.

Figure 13:
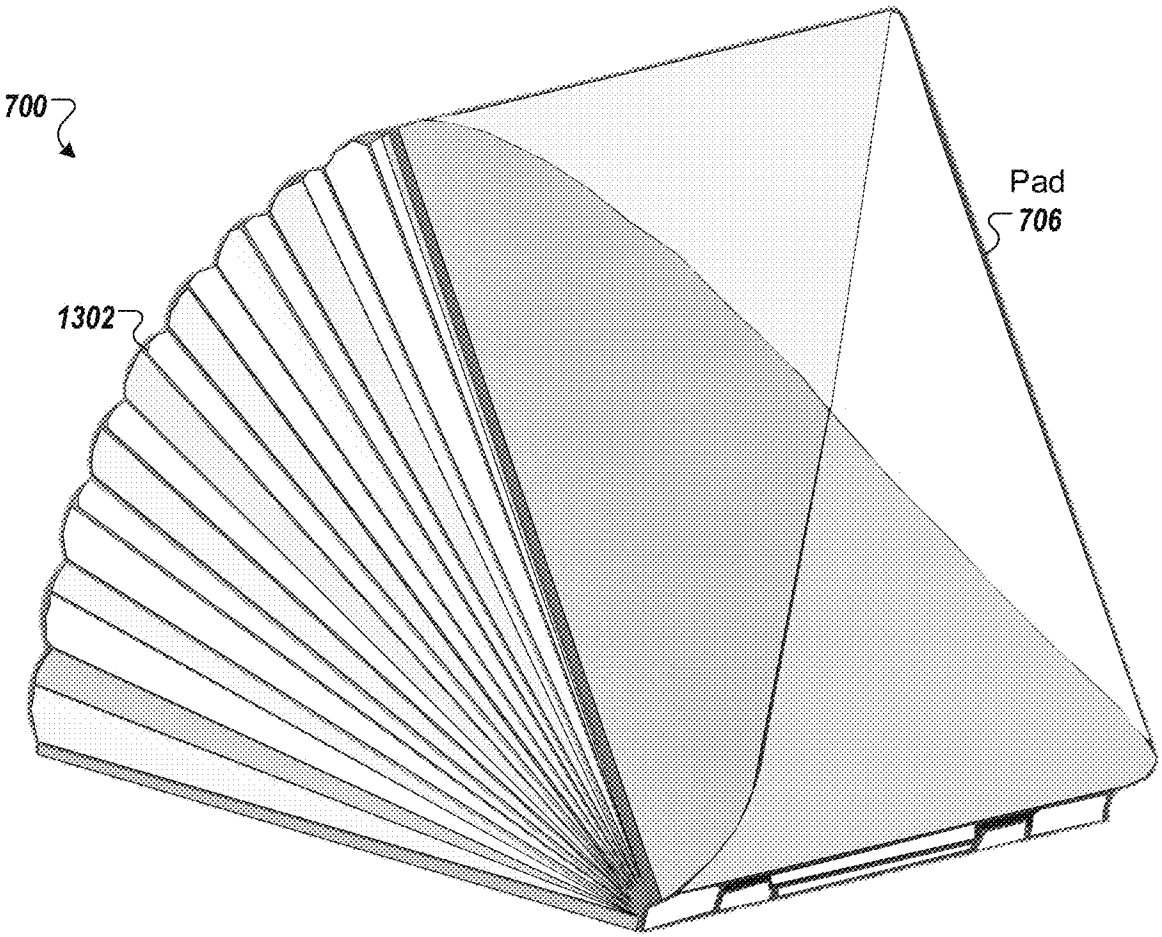
FIG. 13 illustrates a support device with a cover for the frame and inflatable bladder in accordance of various embodiments of the present disclosure.

FIG. 13 illustrates the support device 700 with a cover 1302 for the frame and inflatable bladder in accordance of various embodiments of the present disclosure. As illustrated, the cover 1302 can cover all or some of the frame 702 and the inflatable bladder 708. The cover 1302 can be removable for cleaning. The cover 1302 can be made of various types of materials, including hygienic materials, anti-microbial, or the like. In other embodiments, a cover can also be used to cover the pad 706.

In another embodiment, an adjustable support member device includes a horizontal base member, a support structure that is rotatably coupled to a first end of the horizontal base member, and inflatable bladder disposed between the horizontal base member and the support structure, and an inflator coupled to the inflatable bladder. The inflator and the inflatable bladder are configured to adjust an angle between the horizontal base member and the support structure to position a person between an inclined position and a plurality of inclined positions. In a further embodiment, the inflator includes a pump, a 4-way, 5-port valve system coupled between the pump and the inflatable bladder, and a microcontroller coupled to the pump and the 4-way, S-port valve system. The microcontroller is to control the pump and the 4-way, 5-port valve system to inflate or deflate the inflatable bladder.

In one embodiment, the inflatable bladder includes an outer wall, an inner wall, and one or more ribs coupled between the outer wall and the inner wall. Each rib includes at least one planar port. The at least one rib, the outer wall, and the inner wall form at least two inflatable chambers of the inflatable bladder. A first chamber can inflate before a second chamber inflates. In this case, the first chamber is closer to the horizontal base member than the second chamber. Alternatively, a first chamber can deflate before a second chamber. In this case, the first chamber is closer to the support structure than the second chamber. In some cases, the inflator is disposed on the horizontal base member. In some cases, the inflatable bladder includes three sections, including: a middle section having a first length between an inner wall and an outer wall; a first side section having a second length between the inner wall and the outer wall, the second length being greater than the first length; and a second side section having the second length between the inner wall and the outer wall. The inflator can be disposed in an area between a portion of the first side section and a portion of the second side section. Alternatively, the inflator can be disposed in other locations, such as on the ground, underneath the bed, attached to a frame of a bed or other structures in proximity. The inflatable bladder can have a U-shape. Alternatively, the inflatable bladder can have other shapes.

The inflatable bladders described herein can overcome deficiencies of other bladder systems. For example, large air bladders with an accordion shape can have too much air volume to be filled quickly. Aspects of the inflatable bladders described herein can place most of the bladder profile toward a head of the user and can create lift where it will be used the most, while adding rigidity by extending out to the top of the wedge. By not filling in the whole wedge between the base member and adjustable support member, the fill time can be reduced while optimizing the performance of the air bladder. The configuration of the inflatable bladders described herein, such as using ribs and planar ports, establishes air flow paths between vertical chambers to gradually inflate the inflatable bladder, one chamber at a time. The planar ports can be strategically placed for gradually inflating the inflatable bladder, one chamber at a time. The configuration of the inflatable bladders described herein can include shapes to fit the pump for a smaller device footprint, such as an inflatable bladder having a U-shape. Also, the frame with two pieces with a hinge joint can be used to lift at least 300 pounds with frame rigidity. The hinges can be disposed for correcting lateral forces. Frame boards need to be rigid using composite materials and cutouts (or other holes) can be strategically placed for reducing weight while maintaining strength.

In addition to the features shown in the figures. Other possible embodiments may include heating elements; timer elements that may be used to adjust the incline angle automatically or at preset times; attachments to reduce the discomfort of bed sores; arm rests; an assistance button; folding table; cup holder; massage system; head attachment; or a remote control; an mobile app on a mobile device; or the like. These features may include in one single embodiment or be used in any combination with the other previously mentioned embodiments. Another embodiment may include user interface devices, such as buttons, on the embodiment itself. In addition to aforementioned wired or wireless interface devices, another embodiment may allow the user to interact with the embodiment through a wireless receiver, for example Bluetooth, to use an electronic interface device to interact with the embodiment.

In another embodiment, a support device includes a base member, a hinge element, an adjustable support member, an inflatable bladder, and an inflator. The adjustable support member is affixed to the hinge element such that the adjustable support member may transition relative to the base member using the hinge element. The inflatable bladder is affixed to both the base member and the adjustable support member such that as the internal pressure of the inflatable bladder increases, the inflatable bladder causes the adjustable support member to transition relative to the base member. The inflator is connected to the inflatable bladder through a connection element such that a fluid passes from the inflator to the inflatable bladder. In a further embodiment, the hinge element is at least one of a butt hinge, multiple knife hinges, a living hinge, an extruded PVC hinge. In other embodiments, multiple hinge elements can be used.

In a further embodiment, the support device include the inflatable bladder as a first inflatable bladder and a second inflatable bladder affixed to both the base member and the adjustable support member such that as the internal pressure of the inflatable bladder and the second inflatable bladder increases, the inflatable bladder and the second inflatable bladder cause the adjustable support member to transition relative to the base member.

In some embodiments, the inflator includes a pump. In other embodiments, the inflator includes at least one of a rotary lobe pump, a diaphragm pump, or a gear pump.

In another embodiment, a support device includes a base member, multiple hinge elements, an adjustable support member, multiple inflatable bladders, and an inflator. The adjustable support member is affixed to the hinge elements such that the adjustable support member may transition relative to the base member using the hinge elements. The inflatable bladders are affixed to both the base member and the attachable support such that as the internal pressures of the inflatable bladders increase, the inflatable bladders causes the adjustable support member to transition relative to the base member. The inflator is connected to the inflatable bladder through a connection element such that a fluid may pass from the inflator to the inflatable bladder. In a further embodiment, the hinge elements make up one extruded PVC hinge extending along length of one end of the base member and the adjustable support member.

The present embodiments may be embodied in other specific forms without departing from its spirit or essential characteristics. The described embodiments are to be considered in all respects only as illustrative and not restrictive. The scope of the embodiments is, therefore, indicated by the appended claims rather than by the foregoing description. All changes that come within the meaning and range of equivalency of the claims are to be embraced within their scope.

The various components of the present embodiments may be constructed generally out of any materials known to be suitable in the art.

Many modifications and other embodiments of the present disclosure set forth herein will come to mind to one skilled in the art to which this disclosure pertains and having the benefit of the teaching presented in the foregoing descriptions and the associated drawings. Therefore, it should be understood that the present disclosure is not to be limited to the specific embodiments disclosed and that modifications and other embodiments are intended to be included within the scope of the appended claims. Although specific terms are employed herein, they are used in a generic and descriptive sense only, and not for purposes of limitation.

What is claimed is:

1. A support device comprising:

a frame comprising a base member and an adjustable support member;

a hinge element coupled to a first side of the base member and a first side of the adjustable support member; and an inflatable bladder coupled between a section of the base member and a section of the adjustable support member, wherein the section of the base member is located closer to a second side of the base member than the first side of the base member, wherein the section of the adjustable support member is located closer to a second side of the adjustable support member than the first side of the adjustable support member, wherein the inflatable bladder has a U-shape that forms a recess; and a pump assembly, wherein at least a portion of the pump assembly is disposed on the base member within the recess.

2. The support device of claim 1, wherein the pump assembly comprises a pump coupled to an inlet and an outlet of the inflatable bladder, wherein the pump is configured to increase or decrease an internal pressure of the inflatable bladder, and wherein the inflatable bladder is configured to cause the adjustable support member to rotate about the hinge element as the internal pressure of the inflatable bladder increases or decreases, wherein the inflatable bladder comprises:

an outer wall;

an inner wall; and a plurality of ribs coupled between the outer wall and the inner wall, each of the plurality of ribs comprising a planar port, wherein the plurality of ribs, the outer wall, and the inner wall form a plurality of chambers of the inflatable bladder, wherein the plurality of chambers comprises a first chamber located between a first rib and a second rib of the plurality of ribs, the first rib comprising a first planar port at a first distance from the second side of the adjustable support member and the second rib comprising a second planar port at a second distance from the second side of the adjustable support member, the second distance being greater than the first distance such that first airflow through the first chamber flows between the first planar port and the second planar port.

3. The support device of claim 2, wherein, responsive to the pump increasing the internal pressure from a first amount to a second amount, the first chamber of the plurality of chambers inflates to a substantially filled state before a second chamber of the plurality of chambers inflates, and wherein the first chamber is closer to the section of the base member than the second chamber.

4. The support device of claim 3, wherein, responsive to the pump increasing the internal pressure from the second amount to a third amount, the second chamber inflates to the substantially filled state before a third chamber of the plurality of chambers inflates, wherein the second chamber is closer to the section of the base member than the third chamber, wherein the second chamber is located between the second rib and a third rib of the plurality of ribs, the third rib comprising a third planar port at a third distance from the second side of the adjustable support member, the third distance being less than the second distance such that second airflow through the second chamber flows between the second planar port and the third planar port.

5. The support device of claim 2, wherein the inflatable bladder comprises:

a middle section having a first length between the inner wall and the outer wall;

a first side section having a second length between the inner wall and the outer wall, the second length being greater than the first length; and a second side section having the second length between the inner wall and the outer wall.

6. The support device of claim 5, wherein the pump is disposed in area on the base member defined by a third length between the outer wall of the first side section and the outer wall of the middle section and a width of the middle section.

7. The support device of claim 2, further comprising a valve system coupled between the pump and the inflatable bladder.

8. The support device of claim 7, wherein the pump assembly comprises:

the pump;

the valve system;

a power supply;

an AC/DC converter;

a relay coupled to the pump;

a set of switches, each switch of the set being coupled to a valve of the valve system; and a microcontroller coupled to the power supply, the AC/DC converter, the relay and the set of switches, wherein the microcontroller is configured to control the valve system via the set of switches and the pump via the relay.

9. An adjustable support device comprising:

a horizontal base member;

a support structure that is rotatably coupled to a first end of the horizontal base member;

an inflatable bladder disposed between the horizontal base member and the support structure, wherein the inflatable bladder has a U-shape that forms a recess; and an inflator coupled to the inflatable bladder, wherein the inflator and the inflatable bladder are configured to adjust an angle between the horizontal base member and the support structure to position a person between an inclined position and a plurality of inclined positions, wherein at least a portion of the inflator is disposed on the horizontal base member within the recess.

10. The adjustable support device of claim 9, wherein:

the inflator comprises: a pump; a 4-way, 5-port valve system coupled between the pump and the inflatable bladder; and a microcontroller coupled to the pump and the 4-way, 5-port valve system, wherein the microcontroller is to control the pump and the 4-way, 5-port valve system to inflate or deflate the inflatable bladder;

the inflatable bladder comprises a first chamber located between a first rib and a second rib of the inflatable bladder and a second chamber located between the second rib and a third rib of the inflatable bladder;

the first rib comprises a first planar port that is located at a first distance from the first end of the horizontal base member;

the second rib comprises a second planar port that is located at a second distance from the first end of the horizontal base member; and the first chamber is to inflate to a substantially filled state before the second chamber.

11. The adjustable support device of claim 10, wherein the inflatable bladder comprises:

an outer wall;

an inner wall; and a plurality of ribs coupled between the outer wall and the inner wall, each of the plurality of ribs comprising a planar port, wherein the plurality of ribs, the outer wall, and the inner wall form a plurality of chambers of the inflatable bladder, the plurality of chambers comprising the first chamber and the second chamber and the plurality of ribs comprising the first rib, the second rib, and the third rib.

12. The adjustable support device of claim 11, wherein the first chamber is closer to the horizontal base member than the second chamber.

13. The adjustable support device of claim 11, wherein a third chamber of the plurality of chambers is configured to deflate before the second chamber of the plurality of chambers inflates, wherein the third chamber is closer to the support structure than the second chamber.

14. The adjustable support device of claim 9, wherein the inflatable bladder comprises:

a middle section having a first length between an inner wall and an outer wall;

a first side section having a second length between the inner wall and the outer wall, the second length being greater than the first length; and a second side section having the second length between the inner wall and the outer wall, wherein the inflator is disposed in an area between a portion of the first side section and a portion of the second side section.

15. A method comprising:

disposing a support device on a horizontal surface under a patient, the support device having a base member, an adjustable support member, a hinge element coupled to a first side of the base member and a first side of the adjustable support member, and an inflatable bladder coupled between a section of the base member and a section of the adjustable support member, wherein the inflatable bladder has a U-shape that forms a recess, and wherein at least a portion of a pump assembly is disposed on the base member within the recess; and inflating at least one of a plurality of chambers of the inflatable bladder such that an angle between the base member and the adjustable support member is increased to lift the patient from a horizontal position to a first inclined position, the plurality of chambers being formed between an inner wall, an outer wall, and a plurality of ribs of the inflatable bladder.

16. The method of claim 15, further comprising:

inflating at least one additional chamber of the plurality of chambers such that the angle between the base member and the adjustable support member is increased to further lift the patient from the first inclined position to a second inclined position that is higher than the first inclined position.

17. The method of claim 15, further comprising:

deflating at least one of the plurality of chambers such that the angle between the base member and the adjustable support member is decreased to lower the patient from the first inclined position to a second inclined position that is lower than the first inclined position.

* * * * *